US006398009B1

(12) United States Patent
Emery

(10) Patent No.: US 6,398,009 B1
(45) Date of Patent: Jun. 4, 2002

(54) SHEET CONVEYANCE DEVICE WITH DIVERTER FOR MODULES

(75) Inventor: David Crowell Emery, York, ME (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/546,441

(22) Filed: Apr. 10, 2000

Related U.S. Application Data

(62) Division of application No. 09/018,010, filed on Feb. 3, 1998, now Pat. No. 6,044,958.

(51) Int. Cl.[7] ..... B65G 47/68
(52) U.S. Cl. ..... 198/436; 271/204
(58) Field of Search ..... 271/204, 9.13, 271/903, 264, 279; 198/436, 440, 447, 448

(56) References Cited

U.S. PATENT DOCUMENTS 2,167,343 A * 7/1939 Bergmann ..... 198/436
3,635,322 A * 1/1972 Raudat et al. ..... 198/440
4,917,369 A * 4/1990 Moll et al. ..... 271/204
5,217,105 A * 6/1993 Sapp et al. ..... 198/440
6,007,064 A * 12/1999 Cote et al. ..... 271/204

FOREIGN PATENT DOCUMENTS

AU 249427 * 1/1963 ..... 271/204
DE 551428 * 5/1932 ..... 271/204

* cited by examiner

*Primary Examiner*—H. Grant Skaggs
(74) *Attorney, Agent, or Firm*—Kenyon & Kenyon

(57) ABSTRACT

A sheet delivery device with a first gripper module for carrying a first sheet, a second gripper module for carrying a second sheet, a track for guiding the first and second gripper modules, and a stationary, purely mechanical diverter located at a divergence. The track including a first section, a second section and a third section, the first section diverging at the divergence into the second section and the third section.

3 Claims, 4 Drawing Sheets

SHEET CONVEYANCE DEVICE WITH DIVERTER FOR MODULES

This application is a division of prior application Ser. No. 09/018,010, filed Feb. 3, 1998, now U.S. Pat. 6,044,958.

FIELD OF THE INVENTION

The present invention relates generally to a delivery systems for signatures or sheets of paper, and more particularly to a delivery system which uses modules having grippers.

RELATED TECHNOLOGY

Signature gripping devices are known, for example, which transfer signatures. A single gripper grasps a signature or sheet of paper. The grippers can be arranged on modules, so that a plurality of modules can run along tracks and transfer a plurality of signatures or sheets of paper. For example, U.S. patent application Ser. No. 08/709,796 entitled "Device for Transporting Flat Products to Further Processing Units or Delivery Stations" and filed Sep. 9, 1996 shows a conveyance system comprised of individual gripper modules running on a track for delivering signatures or sheets of paper; it is hereby incorporated by reference herein.

Modules typically run on a track, and often need to be diverted depending on the desired route of the individual sheets or signatures. For example, it may be desirable to send each alternating signature to a different track by performing what is known as an A/B split. To perform such a moving chains or belts with a diverter ball or block to divert the modules may be used. This is a complicated moving mechanical system prone to malfunctioning.

SUMMARY OF THE INVENTION

The present invention provides a sheet delivery device having a first gripper module for carrying a first sheet, a second gripper module for carrying a second sheet, a track for guiding the first and second gripper modules, and a stationary diverter located at a divergence. The track includes a first section, a second section and a third section, the first section diverging at the divergence into the second section and the third section.

The present invention therefore permits the conveyance device which provides a constant flow of modules using a purely mechanical diverter which does not require a power source and is not prone to malfunctioning.

The present invention also provides a sheet delivery device in which a track for guiding the first and second gripper modules includes a first section, a second section and a third section, the first section diverging at a divergence into the second section and the third section, and the first section being at least twice as wide as a maximum width of the first gripper module. This advantageously permits the use of blank modules to achieve a simple and uncomplicated A/B signature split.

DETAILED DESCRIPTION

Figure 1:
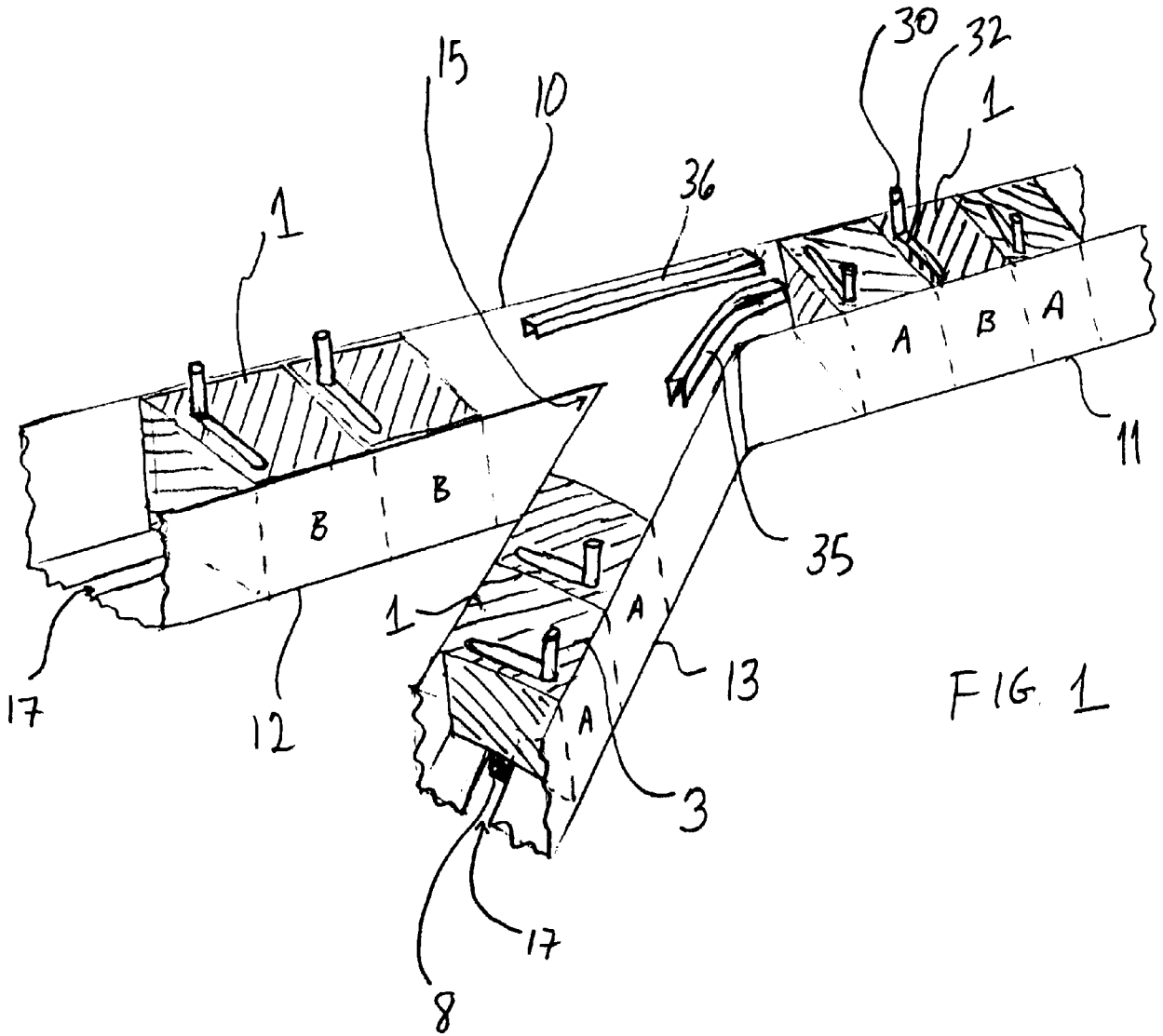
FIG. 1 shows a first embodiment of the present invention, with the gripper modules not being shown in the area of the divergence for purposes of clarity.

FIG. 1 shows a first embodiment of the present invention, in which modules 1 run in a track 10 having a first section 11, a second section 12 and a third section 13. Each module 1 has a module base 3 which runs in the track 10. The modules 1 can be propelled by chains (not shown) alongside of the track or from the module behind, or in any well known manner. Underneath the module base 3, each module has a gripper base 8 which can run in a slot 17 along the bottom of track 10. The gripper base 8 holds a gripper (not shown) which can hold a signature or sheet. The term sheet as used herein includes signatures, printed sheets and all generally flat easily transportable products.

Each module base 3 has at the top a cam follower 30 which can be fixed firmly in one of two positions, either to the left or to the right of a slot 32 as shown.

The first section 11 of track 10 splits at track split 15 into the second section 12, which continues in the same direction as the first section 11, and third section 13, which diverges from the path of the first section 11. Above the track split 15, a first cam race 35 is arranged to divert modules from the first section 11 to the third section 13. As the modules 1 come to the end of the first section 11, those modules with the cam follower 30 on the left side, denoted as "A" modules, are diverted into third section 13. A separate propelling mechanism can be located at the side of section 13, or the modules can be propelled from behind by the following module. Once the module 1 has been diverter into section 13, the cam race 35 ends and the module continues on its path. Those modules with the cam follower 30 on the right side, denoted as "B" modules, are not diverted and continue on into second section 12. A second cam race 36 can be provided to interact with the cam followers 30 of the B modules, although this is not necessary. The cam races 35, 36 may be fastened for example on an overhanging bar or support.

The slot 17 at the bottom of the track 10 at the split must also diverge and can be slightly widened at the divergence to provide for easier transfer during the split. The modules 1 can have rollers or other friction reducing devices for running in the track.

An A/B split is thus achieved. The diverter, comprising the cam race 35, is purely mechanical and stationary and does not require an independent power source. It should be realized that an A/B/C split could also be achieved if the cam followers had a third fixed position in the middle, and a respective cam race was provided.

Figure 2A:
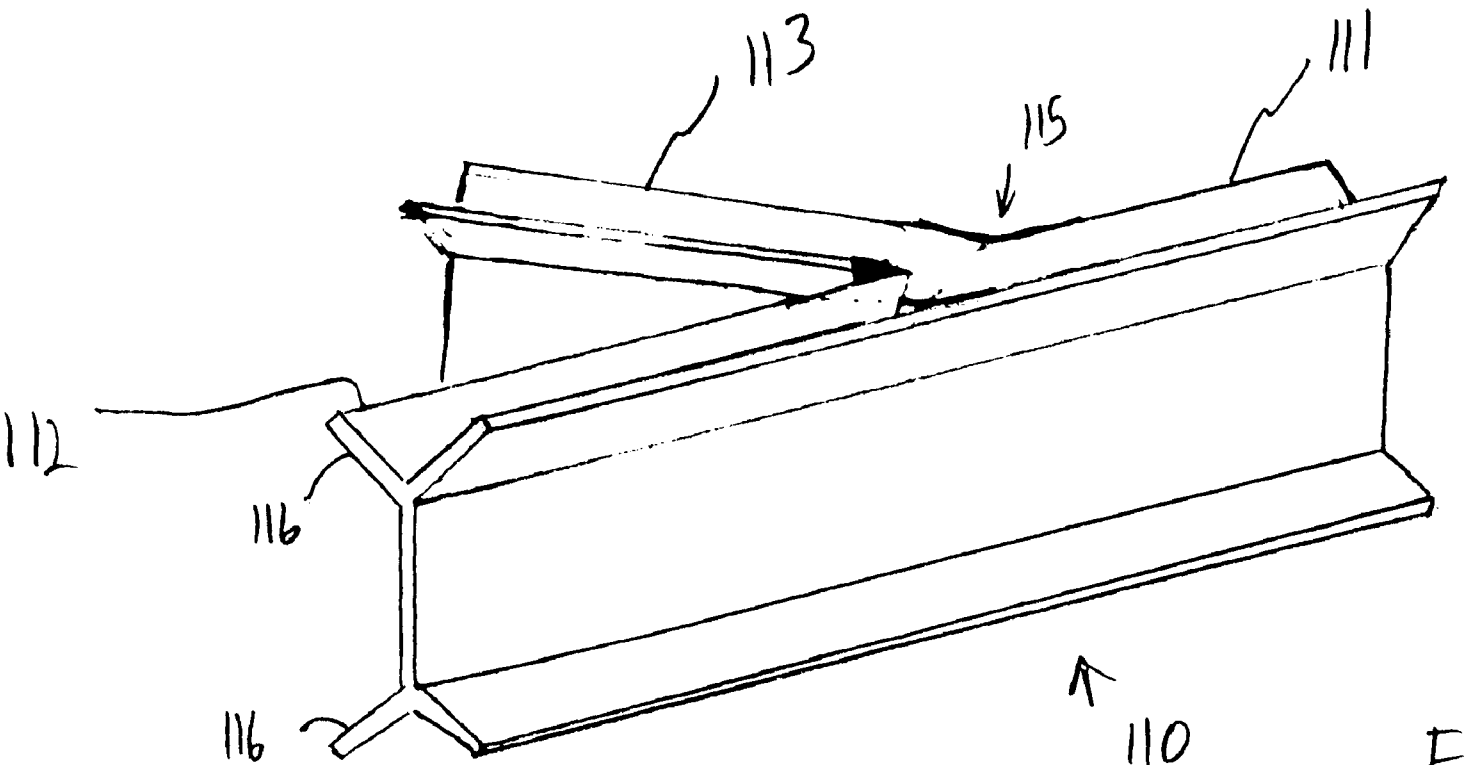
FIG. 2A shows a second embodiment of the present invention.
Figure 2C:
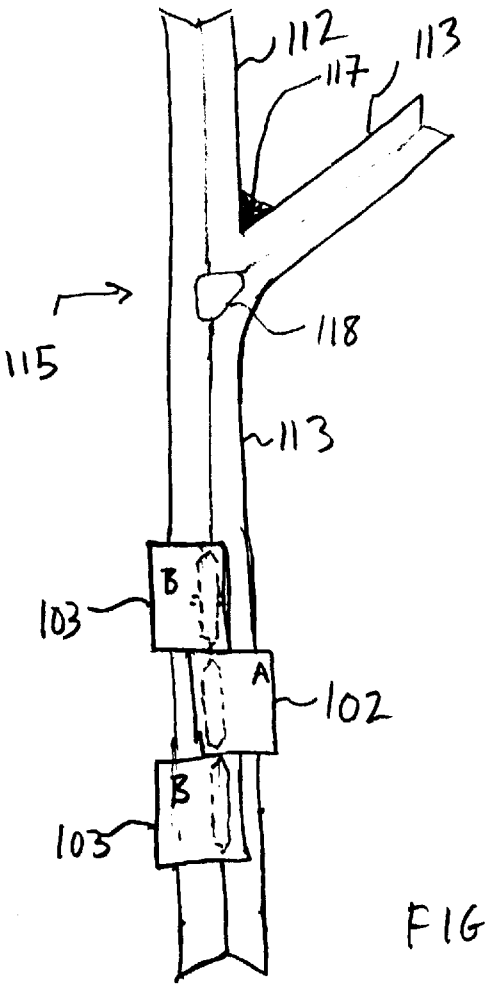
FIG. 2C shows a top view of the second embodiment, with gripper modules shown about to enter the divergence area.
Figure 2B:
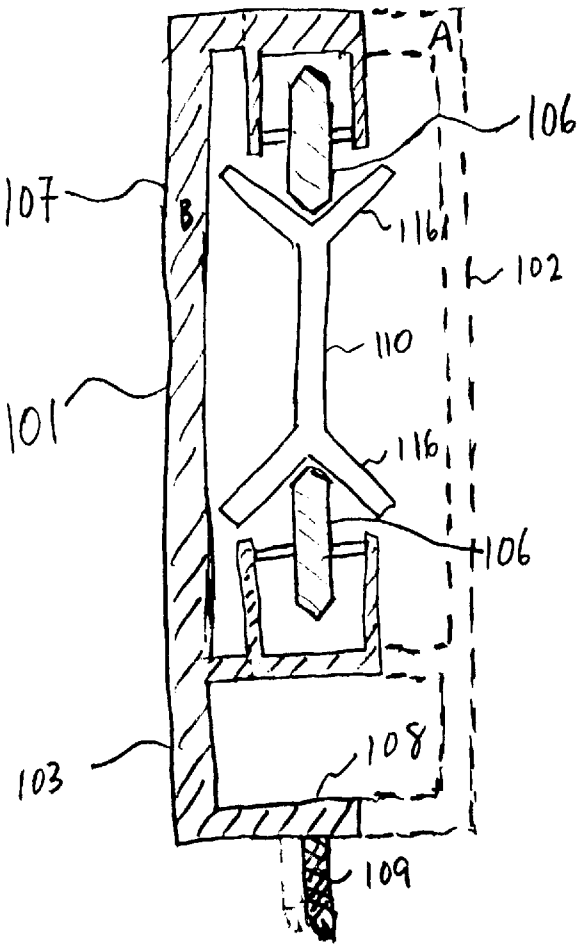
FIG. 2B shows a cross-section view of the second embodiment track and gripper module.

FIGS. 2A, 2B and 2C show a second embodiment of the present invention in which modules 101 run on a "V-ended" I-beam track 110, which has a first section 111 diverging into a second section 112 and a third section 113. The track 10 has V-ends 116.

The modules 101 have rollers 106, a main section 107, a gripper base 108, and a gripper 109 for gripping a sheet or signature. The modules 101 comprise "A" modules 102 and "B" modules 103, the modules 102 being located on one side of the track 110 and modules 103 being located on the other side of the track 110 (they are loaded onto the track 110 in this manner).

As the modules approach a track split 115, the "A" modules 102 are automatically pulled into track section 113, and the "B" modules 103 automatically proceed into track section 112, because of the modules being arranged on different sides of the track 100. At the track split 115 a wedge 117 is formed where the V-ends diverge into track sections 112 and 113. A flat section 118 on the bottom of the track can also be provided so that the wheels 106 can turn more easily at the split 115. Thus the main section 107 can interact with the sides of V-ends 116, scraping along to ensure that the split occurs. In other words, if the "B" modules 103 were to attempt to proceed to track section 113, the main section 107 of the "B" modules would bump against the sides of V-ends 116 and force the "B" modules back into track section 112. An A/B split is thus accomplished in this embodiment using a purely mechanical and stationary diverter, namely the split 115.

The modules can be powered from the side or can be pushed along from the module behind.

Figure 3:
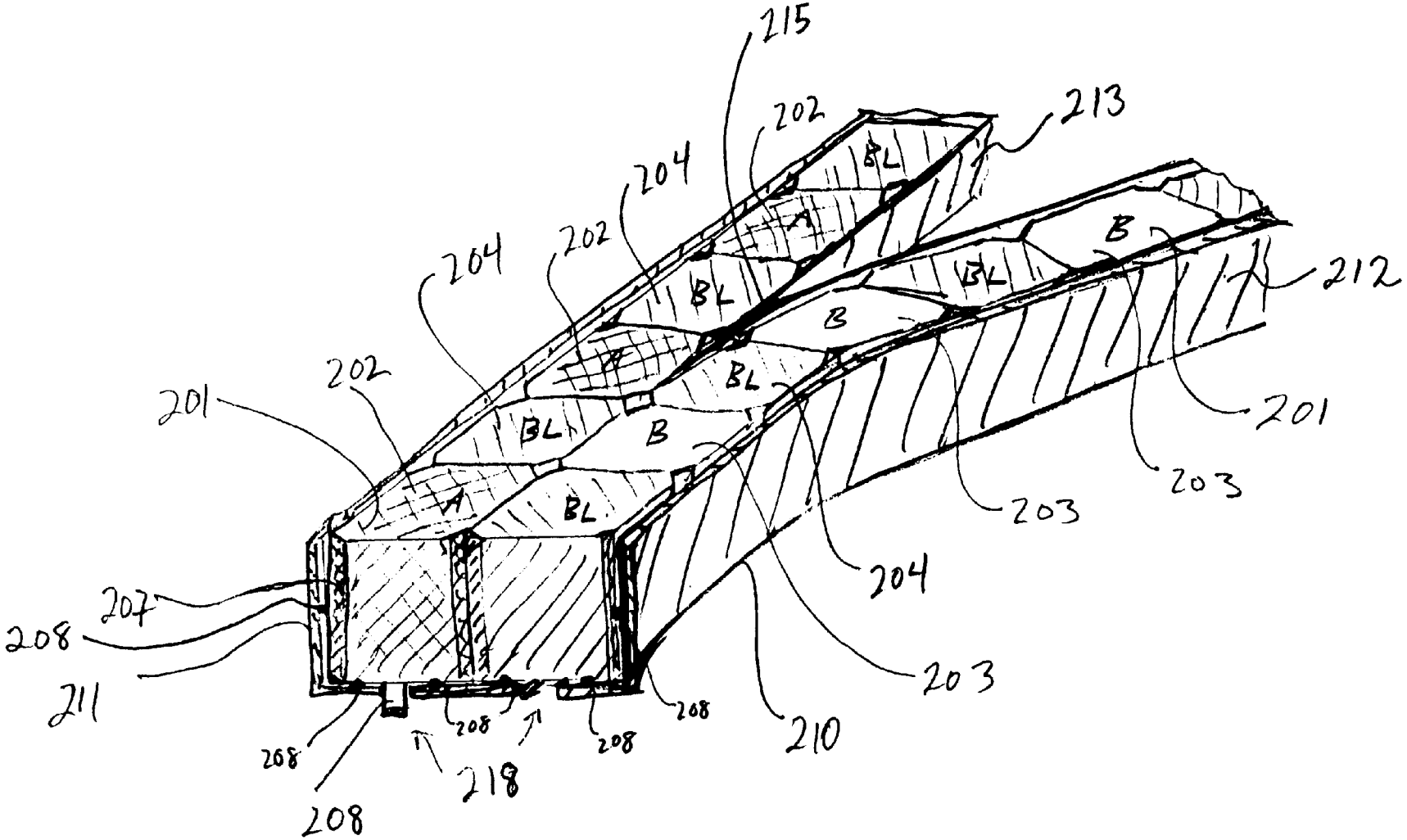
FIG. 3 shows a third embodiment of the present invention.

FIG. 3 shows another embodiment of the present invention in which gripper modules 201 and blank modules 204 are inserted into a first section 211 of a track 210. Each gripper module 201 has a gripper base 208. The blank modules 204 do not need to have grippers and may be merely blocks. The blank modules 204 are inserted so that "A" modules 202 and "B" modules 203 are located on different sides of the first section 211. The first section 211 is thus at least twice as wide as a maximum width of the modules, although preferably not much wider. Two parallel slots 218 are provided at the bottom of the track 210 through which gripper bases 208 of the gripper modules 201 run. (The section of the track 210 between the slots can be supported independent from the rest of the track 210.)

The first section 211 diverges at a split or wedge 215 into second section 212 and third section 213, each of which is slightly wider than a single module width. The wedge 215 thus simply and mechanically diverts the "B" modules 203 into second section 212 and the "A" modules 202 into third section 213.

The gripper modules 201 and blank modules 204 preferably have tapered corners 207 for easier diverting by the wedge 215, and also preferably have a device 208 for reducing the friction of the modules as they run in the track 210, such as rollers, bearings, slides or similar devices as well known in the art. As with the above embodiments, the modules can be powered by a timing belt, a gear mechanism, a chain or a power wheel, and the power can be provided at a sole location along the track, so that the modules push each other forward, or at multiple locations, or continuously at a side of the track.

The diverter, the wedge 115, is thus purely mechanical and stationary and requires no external power source. An A/B/C split could also be achieved using a three module wide first section diverging into three other sections, with two blank modules aside each gripper module.

What is claimed is:

1. A sheet delivery device comprising:

a first gripper module for carrying a first sheet;

a second gripper module for carrying a second sheet;

a track for guiding the first and second gripper modules, the track including a first section, a second section and a third section, the first section diverging at a divergence into the second section and the third section; and a stationary diverter located at the divergence;

wherein the first gripper module comprises a positionable member and the stationary diverter is arranged to selectively divert the first gripper module into the third section depending on a position of the positionable member.

2. The delivery device as recited in claim 1 wherein the positionable member of the first gripper module comprises a first cam follower, and the second gripper module has a second cam follower, the diverter including a cam race for guiding at least one of the first cam follower and second cam follower from the first section to the third section.

3. The delivery device as recited in claim 2 further comprising a further cam race for guiding at least one of the first cam follower and the second cam follower from the first section to the second section.

* * * * *